US005452659A

United States Patent [19]

Pupic

[11] Patent Number: 5,452,659

[45] Date of Patent: Sep. 26, 1995

[54] APPARATUS FOR THE IN-REGISTER ADJUSTING OF PRINTING PLATES ON THE PLATE CYLINDER OF PRINTING MACHINES

[75] Inventor: Nikola Pupic, Heusenstamm, Germany

[73] Assignee: Man Roland Druckmaschinen AG

[21] Appl. No.: 265,395

[22] Filed: Jun. 24, 1994

[30] Foreign Application Priority Data

Jun. 30, 1993 [DE] Germany ..... 43 21 751.6

[51] Int. Cl.[6] ..... B41F 27/06; B41F 27/12; B41L 29/20

[52] U.S. Cl. ..... 101/415.1

[58] Field of Search ..... 101/415.1, 378, 101/407–411; 451/499, 500

[56] References Cited

U.S. PATENT DOCUMENTS

| | | | |
|---|---|---|---|
| 3,107,609 | 10/1963 | Haramija . | |
| 3,973,496 | 8/1976 | Cerny et al. | 101/415.1 |
| 4,010,685 | 3/1977 | Trageser | 101/415.1 |
| 4,191,106 | 3/1980 | Fermi et al. | 101/415.1 |
| 4,757,762 | 7/1988 | Spiegel | 101/415.1 |
| 5,325,778 | 7/1994 | Hartung et al. | 101/415.1 |

FOREIGN PATENT DOCUMENTS

| | | |
|---|---|---|
| 67443 | 12/1971 | Germany . |
| 2065582B2 | 2/1978 | Germany . |
| 3519869C2 | 7/1992 | Germany . |
| 4128994A1 | 7/1992 | Germany . |
| 4214168A1 | 11/1993 | Germany . |

*Primary Examiner*—J. Reed Fisher
*Attorney, Agent, or Firm*—Leydig, Voit & Mayer, Ltd.

[57] ABSTRACT

A mechanism is provided for adjusting printing plates on plate cylinders in sheet-fed offset printing machines. After the leading and trailing edges of the printing plate have been clamped onto the plate cylinder by clamping bars or attachment devices, the adjusting mechanism is utilized to provide circumferential and axial translation of the printing plate relative to the plate cylinder for registration correction. The adjusting mechanism selectively translates only those attachment devices clamping the edge of the printing plate which require this correction. In the preferred embodiment, the adjusting mechanism is a hand tool with a shank having a handle at one end and a cam at the other. Upon placing the tool at predetermined locations on the plate cylinder and turning the handle, the cam acts on the engagement surfaces of the attachment devices which are pivotable about their longitudinal axis causing circumferential translation of the printing plate. Additionally, the tool can be placed at predetermined locations at the ends of the attachment devices whereby turning of the handle results in axial translation of the attachment devices and the printing plate edge clamped therein.

9 Claims, 3 Drawing Sheets

APPARATUS FOR THE IN-REGISTER ADJUSTING OF PRINTING PLATES ON THE PLATE CYLINDER OF PRINTING MACHINES

FIELD OF THE INVENTION

The invention relates generally to an apparatus for the in-register adjusting of printing plates on the plate cylinder of printing machines and more particularly concerns such an adjusting device for use on sheet-fed offset printing machines.

BACKGROUND OF THE INVENTION

In sheet-fed offset printing machines, a printing plate is attached on the plate cylinder by means of clamping bars or attachment devices arranged in a cylinder recess. First, the leading edge of the printing plate is clamped in the corresponding clamping bar. Then, the printing plate is placed around the outer circumference of the plate cylinder by turning the latter forward slowly. Finally, the trailing edge of the printing plate is clamped in the second clamping bar, or fixed in another way. The printing plate is then subjected to a tensile force in the circumferential direction of the plate cylinder by means of the second clamping bar or attachment device in which the trailing edge of the printing plate is clamped.

An attachment device, assigned to the trailing edge of the printing plate and disposed in an axially parallel recess of the plate cylinder is known from U.S. Pat. No. 3,107,609. The tensile force causing plate tensioning is applied by compression springs assigned to the attachment device. A plurality of attachment devices, spaced apart axially, provide for the attachment of the printing plate on the plate cylinder. A restoring device is provided in the form of a shaft with eccentrics which presses the attachment devices counter to the force of the spring elements in the direction of the trailing edge of the plate. In this pressed-forward position, the trailing edge of the plate can be fixed on the attachment devices. In this case, the attachment devices are mounted so as to be pivotable about an axis running parallel to the axis of the plate cylinder.

A clamping and tensioning device for the plate cylinder of printing machines of a comparable type is known from DE 4,128,994 A1. In this case, the attachment devices are designed as a clamping bar which is subdivided over the format width of the printing plate and consists of a tensioning rail and a clamping rail. The clamping bar is mounted so as to be pivotable about its axis. Compression springs are assigned to the individual clamping bar sections which apply the tensioning force after the printing plate has been clamped by pivoting the clamping bar sections. A restoring element provides the tension-relief of the printing plate by pivoting the clamping bar sections counter to the force of the compression springs.

A pivotable clamping bar is also known from copending U.S. application Ser. No. 08/056,293 entitled "Device for Clamping and Tensioning Printing Plates," issued on Jul. 5, 1994 as U.S. Pat. No. 5,325,778, and which is hereby incorporated by reference in the present application. The U.S. Pat. No. 5,325,778 claims priority from German Patent Application P 4 214 168.0–27. There the tensioning force for the printing plates is applied by means of individual compression springs in a manner similar to how this present invention is used. The clamping bar is subdivided several times over the format width and a compression spring is assigned to each individual clamping bar section. Adjusting screws, as described in the first above-mentioned U.S. Pat. No. 3,107,609, provide means to adjust the compression springs such that different tensions can be applied to sections of the printing plate. This correction possibility is important, especially in the case of printing plates in sheet-fed offset printing machines, since the printed paper tends to become distorted due to damping medium and different subject distribution, especially at the trailing edge of print. The register problems produced from these sources have to be compensated by tensioning the printing plates to different degrees over the format width.

However, the foregoing system operates such that the force correction through the adjusting screws requires a multiplicity of revolutions until the corresponding stretching forces act on the printing plate due to the series connection of a tensioning screw and a compression spring. When a printing plate is changed, the individual tensioning screws then have to be turned back to their original position again in order for the subsequent printing plate not to be distorted by the previously set tensioning force acting differently over the format width.

A clamping bar for the plate cylinder of printing machines is known from DE 3,519,869 C2, in which the rear clamping bar is supported fixedly on the plate cylinder by means of spaced-apart tensioning screws. In this case, the tensioning screws act in a positive-locking manner directly on the cylinder body so that different distortion of the printing plate can be achieved with a relatively small turning angle of the individual tensioning screws. In this case, too, the corresponding adjustments must be reversed again when an old printing plate has been removed. In order that the tensioning and the tension relief of the screws can be carried out as quickly as possible, this publication proposes a hand tool for moving the clamping bar in the tensioning direction. However, rapid turning of the tensioning screws by hand and actuation of the hand tool must take place simultaneously.

OBJECT AND SUMMARY OF THE INVENTION

The object of the present invention is to provide in-register adjustment of printing plates by simple means and with little operating effort.

According to a preferred embodiment of the invention, a manually actuable adjusting tool of simple design is provided. The tool is essentially comprised of a shank, a handle mounted at one end of the shank, and a cam piece (eccentric) mounted at the other end of the shank. After a printing plate has been clamped on the plate cylinder and printing corrections must be carried out, this tool is inserted at the end at which the cam piece is located into a bore in the plate cylinder recess adjacent to the clamping bar section at which correction is required. By turning the tool and the cam piece, this clamping bar section is then moved by precisely the intended amount in the direction of greater tensioning of the printing plate. When the correction by the required amount has been carried out, the tool is removed from the bore again. Since the printing plate has a very high friction force on the plate cylinder after tensioning by the cam has occurred, the slightly smaller force of the spring element or spring elements is now sufficient to maintain this correction. Put simply, the forces exerted on each attachment device provide for a balancing moment such that the attachment device remains stable.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
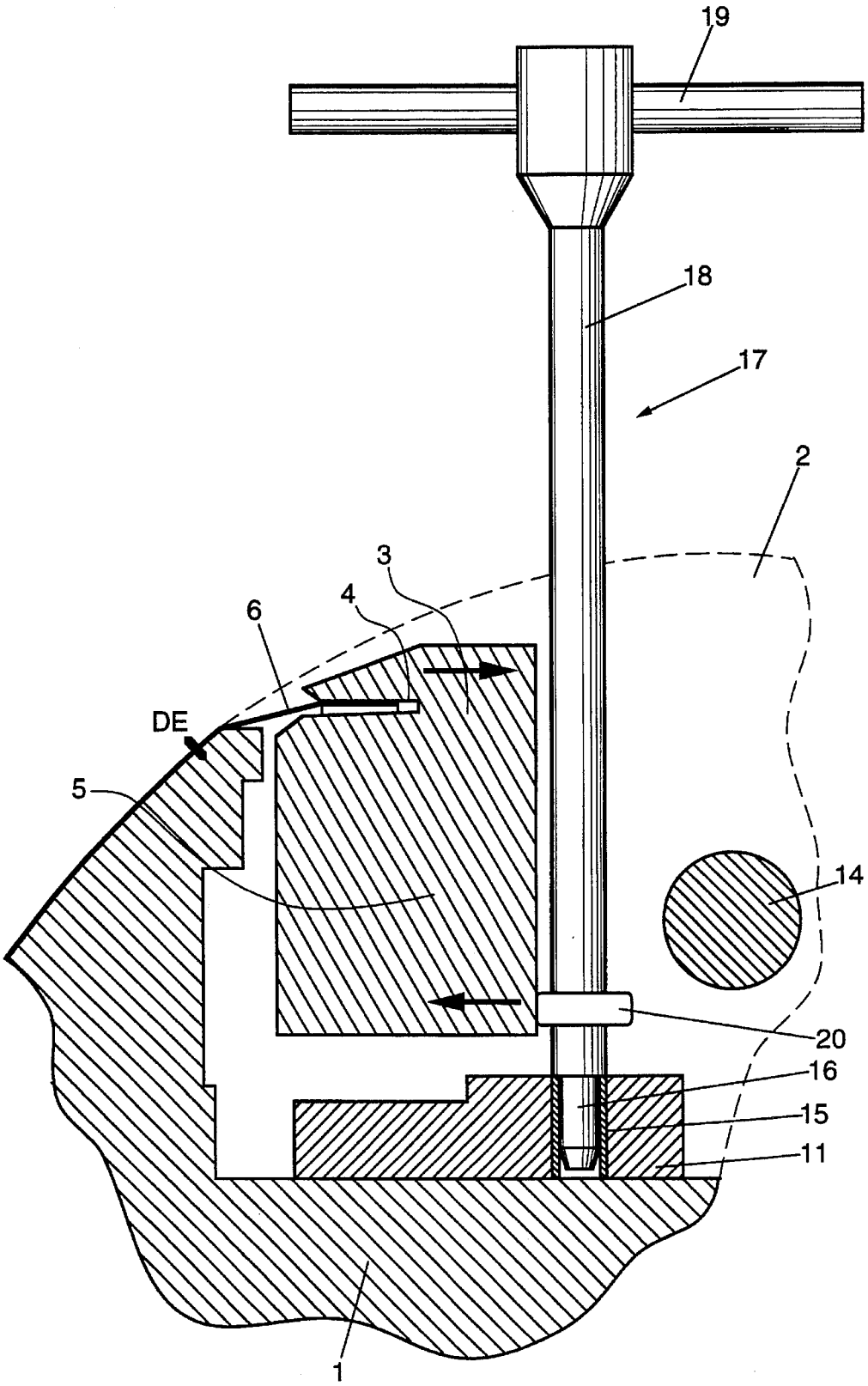
FIG. 1 shows a section through the printing plate clamping bar located in the recess of a plate cylinder and the adjusting tool according to the invention (section A—A on FIG. 2)
Figure 2:
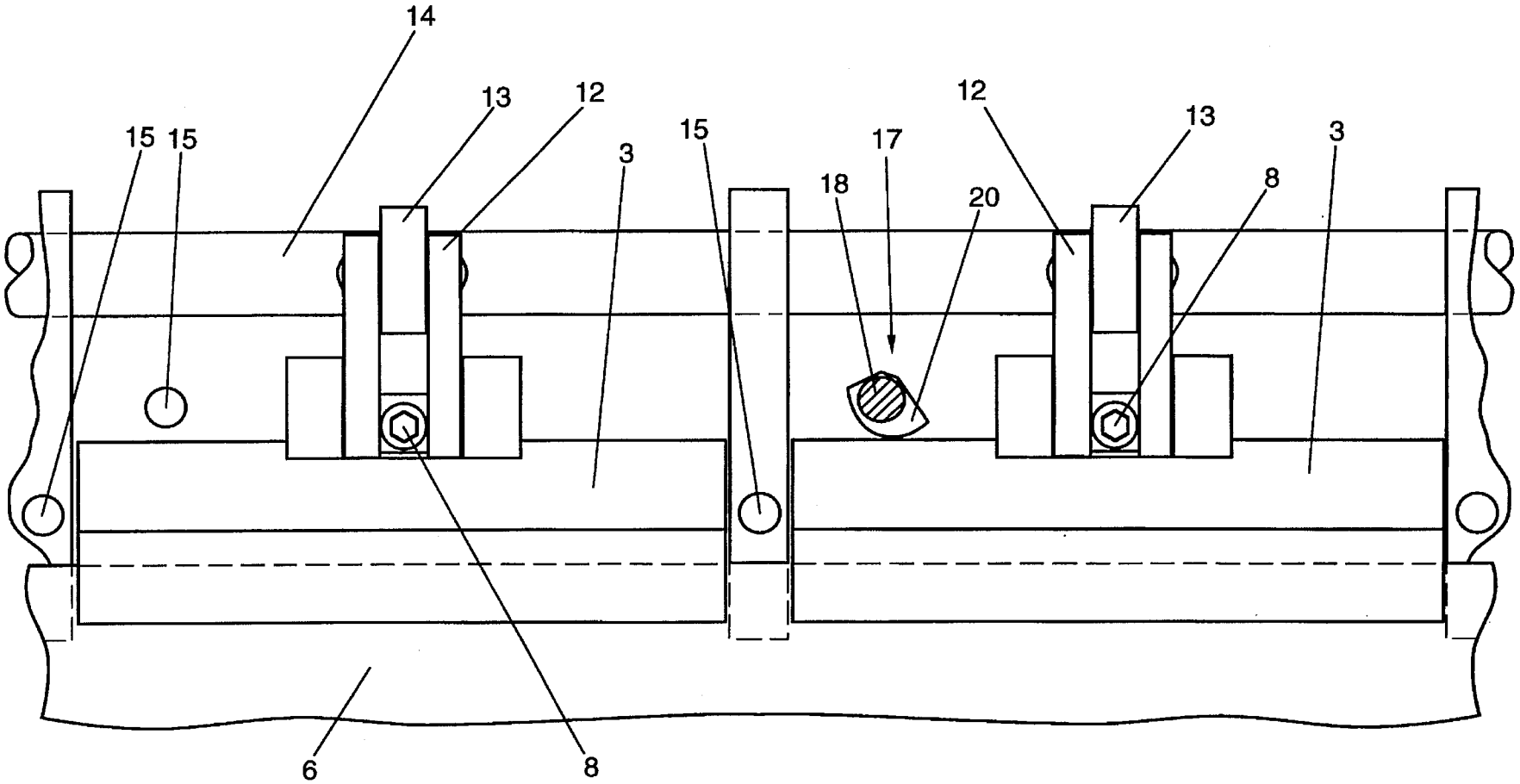
FIG. 2 shows two clamping bar sections in a view from above with the associated locating bores for insertion of the adjusting tool.
Figure 3:
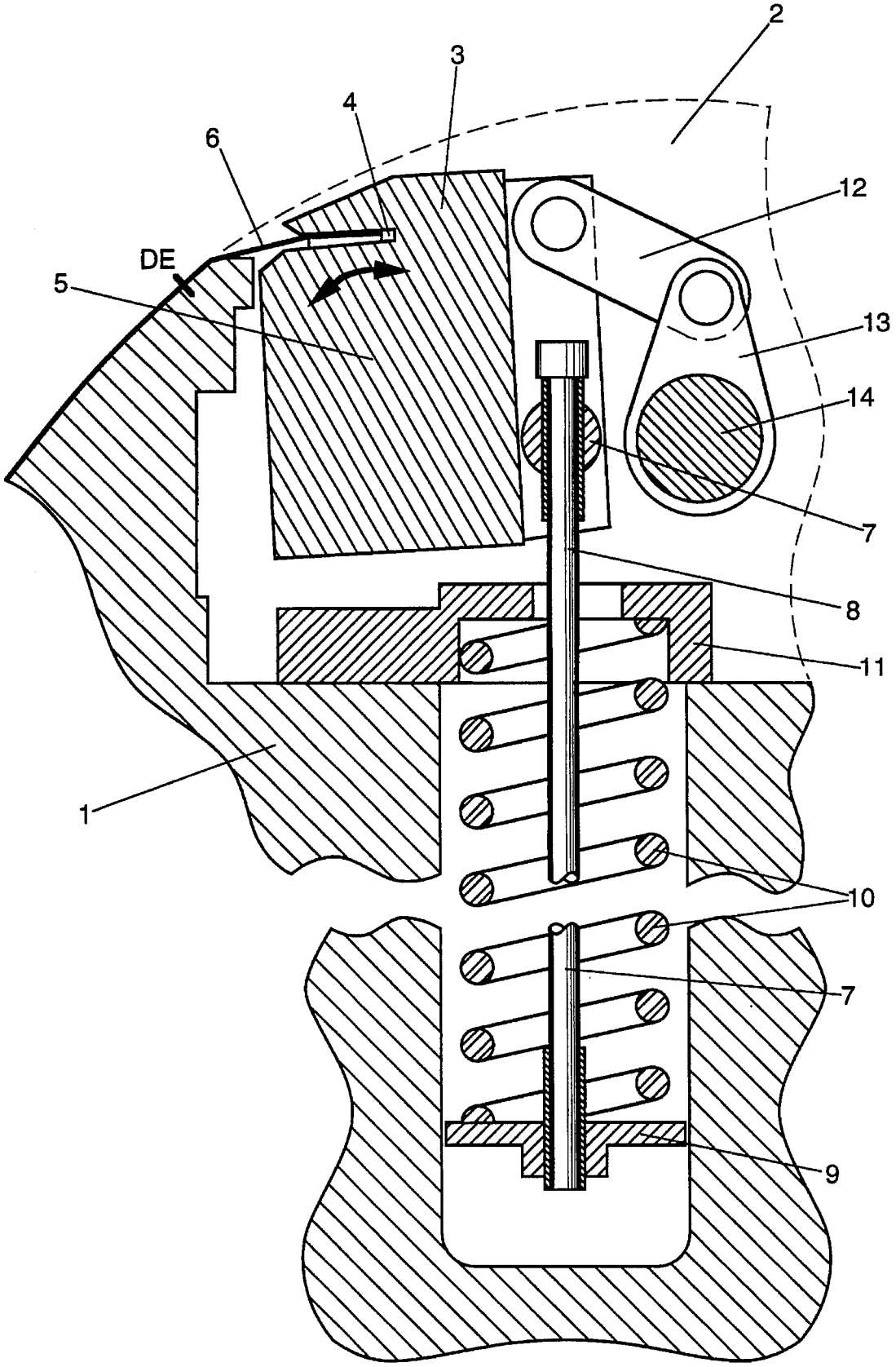
FIG. 3 is a section through the clamping bar and plate cylinder in the area of the plate tensioning compression spring (section B—B on FIG. 2).

With reference to FIGS. 1 through 3, the preferred embodiment of the clamping device will now be explained.

FIG. 3 shows a section of part of the plate cylinder 1 with the axially parallel recess 2 located therein. The trailing edge of the plate cylinder 1 is marked DE. A plurality of attachment devices 3 are mounted over the format width of the printing plate so as to be pivotable about a pivot axle 5 which is fixed on the cylinder. Alternatively, these attachment devices 3 can be a series of conventional clamping bars which are pivotably attached to intermediate supports in the primary recess 2 and thus rotate independently. FIG. 2 shows two attachment devices 3 or clamping bar sections in a view from above.

Each clamping bar or each attachment device 3 has a gripping region 4 across its width for inserting the region assigned to the trailing edge DE of the printing plate. In the example shown, this gripping region 4 is designed as a corresponding receiving gap for the end of the printing plate in which the printing plate is clamped by means which are not shown, but are commonly known. To release an old printing plate or to insert a new printing plate, the gripping region 4 is opened.

One end of a connecting rod 8 is linked by a screw connection via a through-bore bolt 7 to the attachment devices 3 or to each clamping bar (FIG. 2). A disc 9 at the other end of the connecting rod 8 is located in a secondary recess in the plate cylinder 1 below the bottom of the primary recess 2. In this case, the connecting rod 8 is passed through a corresponding through-hole in a recess plate 11 arranged fixedly at the bottom of the primary recess 2. A compression spring 10 is tensioned between the underside of the recess plate 11 and the disc 9 mounted on the connecting rod 8. The compression spring 10 provides a force which pivots the attachment device 3 or the clamping bar from the position shown in FIG. 3 about the pivot axle 5 in the clockwise direction.

A pair of straps 12 is linked between the attachment devices 3 or the clamping bar and a lever 13 on an actuating shaft 14. As indicated in FIG. 2, each attachment device 3 or each clamping bar is connected to a compression spring 10 acting via the connecting rod 8 and to a pair of straps 12, each having a lever 13. In this case, all the attachment devices 3 or clamping bar are pivoted by rotation of the common actuating shaft 14.

It can be seen from FIG. 3 that the attachment device 3 or the clamping bar shown is pressed forward (see arrow) by pivoting the actuating shaft 14 counter to the force of the compression spring 10 (counterclockwise). The attachment device 3 or clamping bar can then be pivoted right back into the position shown in FIG. 3. The actuating shaft 14 can be actuated by drive means located inside or outside the plate cylinder 1.

To insert a new printing plate 6, all the attachment devices 3 or clamping bars are pivoted back in the direction of the center of the primary recess 2 by rotating the actuating shaft 14 clockwise which relieves the tension of the compression springs 10. The printing plate 6 is then placed flatly over its entire format width beyond the trailing edge DE. By rotating the actuating shaft 14 in the counterclockwise direction, an over-compression of the compression springs 10 takes place and the attachment devices 3 or clamping bar are pivoted forward into the position shown in FIG. 3. In this position, the trailing edge of the printing plate 6 is clamped. The tension of the actuating shaft 14 is then relieved so that the forces stored in the compression springs 10 apply tension to the printing plate 6.

As illustrated in FIG. 2, a bore 15 is formed in each recess plate 11 fixed on the plate cylinder. The bores 15 are located laterally next to the links of the connecting rods 8 and the compression springs 10. In this case, the end of a manually actuable adjusting tool, denoted in general by 17, can be inserted in each bore 15, as shown in FIG. 1. According to FIG. 1, the adjusting tool consists of a shaft-like shank 18 with a journal 16 at its bottom which is to be introduced into the bores 15. A handle 19 which is formed, for example, from two transverse bolts is mounted on the opposing, or top end of the shank 18 for the manual application of a relatively large torque.

Above the journal 16, the adjusting tool 17 has a cam piece 20 which is illustrated in FIG. 2 in the form of an eccentric section. In the preferred embodiment, the outer contour of this cam piece 20 is a ball-shaped design so that when the cam piece 20 is turned, it acts on the corresponding part of the attachment device 3 or clamping bar depending on the pivoted position of the attachment device 3. The bores 15 and the minimum and maximum stroke of the cam piece 20 are preferably selected such that a sufficiently large correction path for pivoting the attachment devices 3 is possible in any case. As can also be seen in FIG. 1, the cam piece 20 is mounted at such a height of the adjusting tool 17 introduced by the journal 16 into the bore 15 that the outer contour of the cam piece 20 engages with optimum leverage on the engagement surface located on the lower side of the attachment device 3 facing the primary recess 2. Thus, an additional pivoting of the attachment device 3 or clamping bar takes place upon manual turning of the adjusting tool 17. In this case, the printing plate 6 is stretched in the corresponding attach device 3 or clamping bar region beyond the initial length and thus the required correction is produced.

Additionally, the pitch of the cam piece 20 can be matched to a half-revolution or a complete revolution of the handle 19 of the adjusting tool 17 so that there is a linear relation between the turning of the adjusting tool 17 and the pivoting of the attachment device 3.

Further in accordance with the invention, the adjusting tool 17 can be used to adjust the attachment devices 3 longitudinally along their pivot axis. In this instance, the journal 16 of the adjusting tool 17 is inserted into a bore 15 disposed adjacent to the attachment devices 3 on an engagement surface formed on the end of the attachment device 3 substantially perpendicular to the pivot axis of the attachment device 3. Thus, the attachment device 3 is translated along the pivot axis to produced the required axial printing plate correction.

According to another embodiment, provisions can be made for additional tensioning devices assigned to the clamping bar sections to be arranged as hydraulic, pneumatic or electrical remote-controllable devices in the gap of the plate cylinder. For example, hydraulic pistons in their starting or rest position do not act in a positive-locking manner on the clamping bar. The piston rod of this hydraulic cylinder can be brought into positive-locking contact with the clamping bar after a first actuation. The clamping bar can then be moved over the correction path by a corresponding action of the pressure medium. The correction path could be recorded, for example by position sensors mounted on the clamping bar. It would also be possible to assess the correction produced by evaluating specimen sheets and to stop the correction precisely when the printing result is satisfactory in terms of this criterion. When the correction has been carried out, the corresponding working cylinder is returned to its starting position again by relief of the pressure medium. Thus, the piston rod then no longer has a positive-locking contact with the corresponding clamping bar section.

I claim as my invention:

1. A mechanism for adjusting the registration of a printing plate on the surface of a plate cylinder of a printing machine, said plate cylinder having a first axis and an axis-parallel recess in the periphery thereof, said adjusting mechanism comprising, in combination, clamping means disposed in said recess and mounted for rotation on a second axis parallel to said first axis, said clamping means including a plate receiving gap therein for fastening the leading edge of said printing plate to said clamping means, biasing means for rotating said clamping means about said second axis for tensioning and maintaining the position of said printing plate on said plate cylinder surface, means for defining an engagement surface on said clamping means, actuating means for transmitting a force on said clamping means opposing the force of said biasing means to rotate said clamping means about said second axis during attachment and removal of said printing plate;

and separate adjusting means for selectively adjusting the registration of said tensioned printing plate while maintaining it under tension, said adjusting means being engageable with said engagement surface for selectively applying a positive force thereon to reposition said clamping means and the tensioned printing plate to an adjusted position, said biasing means thereafter maintaining the clamping means and tensioned printing plate in the adjusted position.

2. An adjusting mechanism as defined in claim 1, wherein said clamping means includes a plurality of individual attachment devices longitudinally spaced along and individually pivotable about said second axis, each of said attachment devices having an engagement surface thereon and wherein said adjusting means is selectively engageable with said engagement surface on each of said attachment devices for repositioning the same and simultaneously urging said tensioned printing plate to an adjusted position.

3. An adjusting mechanism as defined in a claim 2, wherein said attachment devices are mounted for displacement axially along said second axis, and said adjusting mechanism includes stop means for limiting the displacement of each of said attachment devices.

4. An adjusting mechanism as defined in claim 3, wherein said engagement surfaces are disposed perpendicular to said second axis and cooperate with said adjusting means for effectuating axial translation of said attachment devices and parallel along said second axis.

5. An adjusting mechanism as defined in claim 2, wherein said engagement surfaces are disposed parallel to said second axis and cooperate with said adjusting means for effectuating rotation of said attachment devices about said second axis.

6. An adjusting mechanism as defined in claim 1, including locating means disposed in said recess and wherein said adjusting means includes a hand tool selectively positionable in said locating means and contacting said engagement surfaces, said hand tool being manually moveable thereby adjusting said clamping means by an amount required for registration correction of said printing plate on said plate cylinder.

7. An adjusting mechanism as defined in claim 6, wherein said tool includes a shank having a top and bottom end, a handle at the top end of said shank, and a cam positioned at a distance above the bottom end of said shank, said locating means includes a plurality of bores located in said plate cylinder recess and wherein the bottom end of said shank is selectively placed in one of said bores and said handle is rotated causing said cam to contact said engagement surface and reposition said clamping means.

8. An adjusting mechanism as defined in claim 7, wherein said cam includes a progressive outer contour causing linear displacement of said attachment devices corresponding to a predetermined angular rotation of said handle.

9. An adjusting mechanism as defined in claim 1, wherein said actuating means includes an actuating shaft disposed in and parallel to said recess, a lever secured to said shaft and a rigid strap connected to both said clamping means and said lever, and wherein rotation of said shaft causes said clamping means to rotate about said second axis.

* * * * *